US006218771B1

(12) United States Patent
Berishev et al.

(10) Patent No.: US 6,218,771 B1
(45) Date of Patent: Apr. 17, 2001

(54) GROUP III NITRIDE FIELD EMITTERS

(75) Inventors: Igor Berishev; Abdelhak Bensaoula, both of Houston, TX (US)

(73) Assignee: University of Houston, Houston, TX (US)

( * ) Notice: Subject to any disclaimer, the term of this patent is extended or adjusted under 35 U.S.C. 154(b) by 0 days.

(21) Appl. No.: 09/105,488

(22) Filed: Jun. 26, 1998

(51) Int. Cl.[7] ..... H01J 19/06
(52) U.S. Cl. ..... 313/311; 313/495; 257/76
(58) Field of Search ..... 313/309, 310, 313/311, 336, 351, 495; 257/76, 10, 94, 96, 103

(56) References Cited

U.S. PATENT DOCUMENTS

| | | | | |
|---|---|---|---|---|
| 5,536,193 | | 7/1996 | Kumar | 445/50 |
| 5,686,791 | | 11/1997 | Kumar et al. | 313/495 |
| 5,713,775 | | 2/1998 | Geis et al. | 445/51 |
| 6,045,626 | * | 4/2000 | Yano et al. | 148/33.4 |

OTHER PUBLICATIONS

S.N. Basu, et al., "Microstructures of GaN films deposited on (001) and (111) Si substrates using electron cyclotron resonance assisted–molecular beam epitaxy." *Journal of Materials Research* vol. 9, Issue 9, Sep. 1994, pp. 2370–3478.

M. W. Geis, "Comparison of Electric Field Emission from Nitrogen–doped, Type 1b Diamond, and Boron–doped Diamond." *Applied Physics Letters* vol. 68, No. 16, Apr. 15, 1996, pp. 2294–2296.

J. W. Yang, et al., "High Quality GaN–InGan Heterostructures Grown on (111) Silicon Substrates." *Applied Physics Letters* vol. 69, No. 23, Dec. 2, 1996, pp. 3566–3568.

T. Kozawa, et al., "Fabrication of GaN Field Emitter Arrays by Selective Area Growth Technique."*Journal of Vacuum Science Technology* vol. 16, No. 2, Mar./Apr. 1998, pp. 833–835.

A. T. Sowers, et al., "Thin Films of Aluminum Nitride and Aluminum Gallium Nitride for Cold CAthode Applications." *Applied Physics Letters* vol. 71, No. 16, Oct. 20, 1997, pp. 2289–2291.

Dihu Chen, et al., "Electron Field Emission from SiC/Si Heterostructures Synthesized by Carbon Implantation Using a Metal Vapor Vacuum Arc Ion Source." *Applied Phsyics Letters* vol. 72, No. 15, Apr. 13, 1998, pp. 1926–1928.

Ester Kim, et al., "Nucleation and Growth of Chemical Beam Epitaxy Gallium Nitride Thin Films." *Applied Physics Letters* vol. 71, No. 21, Nov. 24, 1997, pp. 3072–3074.

P. Kung, et al., "Metalorganic Chemical Vapor deposition of Monocrystalline GaN tThin Films of Beta–LiGaO2 Substrates." *Applied Physics Letters* vol. 69, No. 14, Sep. 30, 1996, pp. 2116–2118.

(List continued on next page.)

*Primary Examiner*—Nimeshkumar D. Patel
*Assistant Examiner*—Joseph Williams
(74) *Attorney, Agent, or Firm*—Baker Botts L.L.P.

(57) ABSTRACT

Field emitter as a source of electrons and method for making are provided. The emitter is formed by growth of a nitride compound of a group III element or alloys of group III elements on a substrate having a lattice mismatch with the thin film. The lattice mismatch causes columnar growth in the film. The micro columns have tips, thus forming an array of crystalline microtips of the low work function nitride material. The nitride compound is doped during growth. Gallium nitride grown on (111) silicon and doped with silicon produces a surface having low threshold electric field for emission and high current per unit area.

11 Claims, 3 Drawing Sheets

OTHER PUBLICATIONS

Robert D. Underwood, et at., "GaN Feld Emitter Array Diode with Integrated Anode." *Journal of Vacuum Scienty Technology* vol. 16, No. 2, Mar./Apr. 1998, pp. 822–825.

James E. Jaskie, "Diamond–Based Field–Emission Displays." MRS Bulletin Mar. 1996, pp. 59–64.

M. A. L. Johnson, et al., "Molecular Beam Epitaxy Growth and Properties of GaN, $A1_xGA_{1-x}N$, and AIN on GaN/SiC Substrates." Journal of Vacuum Science Technology vol. 14, No. 3, May/Jun. 1996, pp. 2349–2353.

* cited by examiner

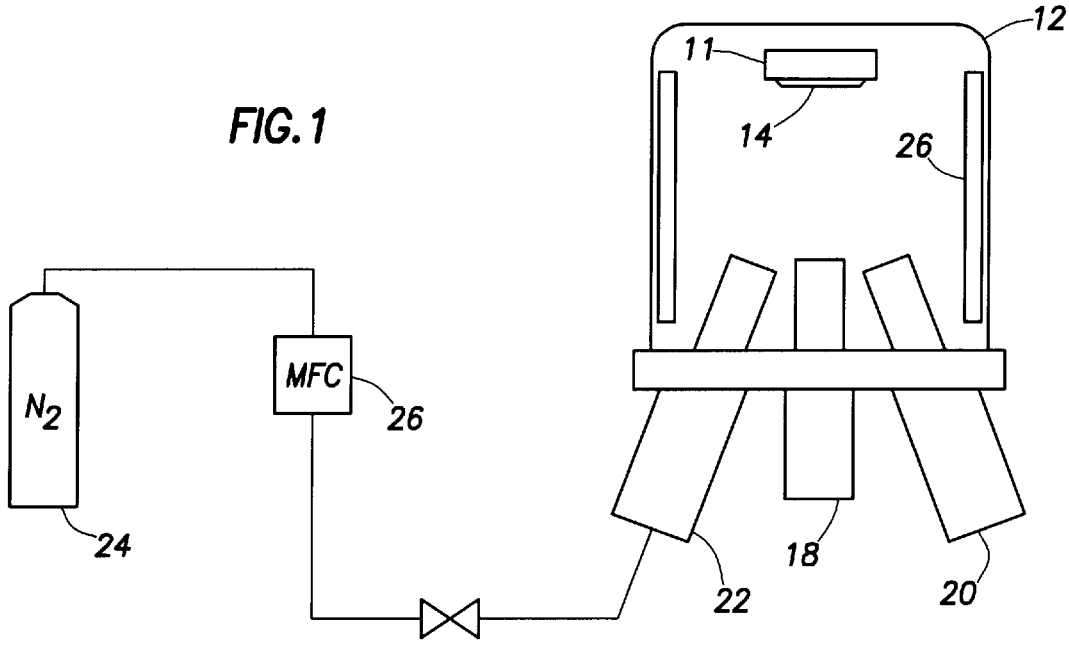
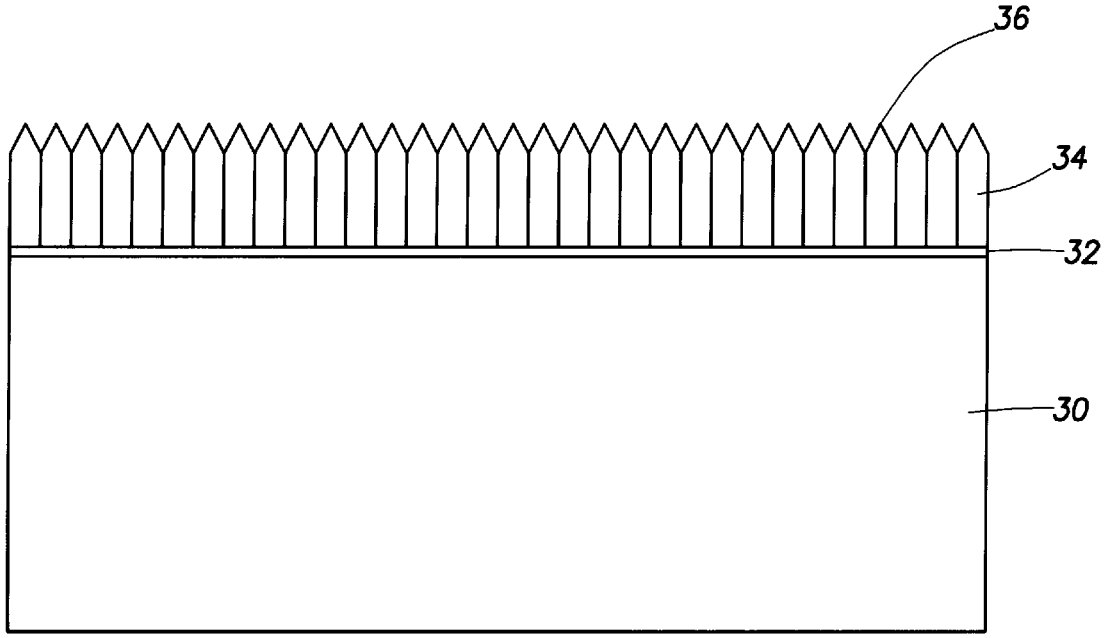
FIG. 2

FIG.4
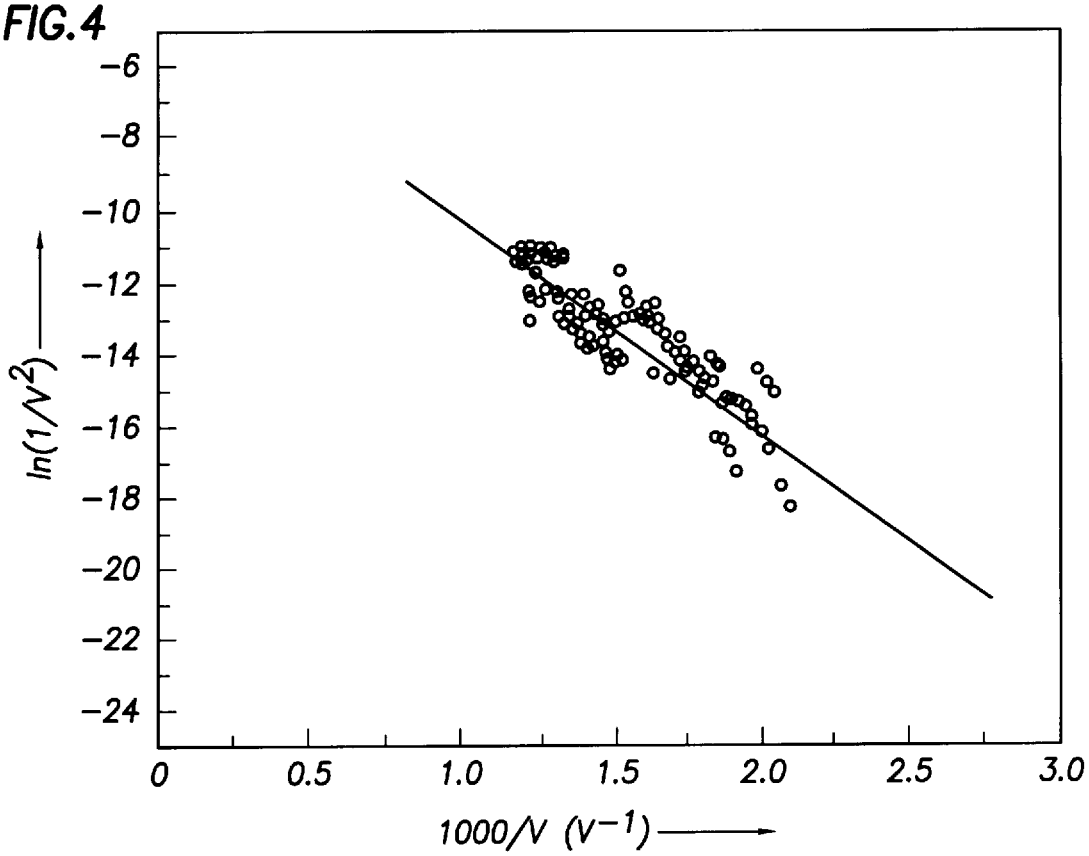
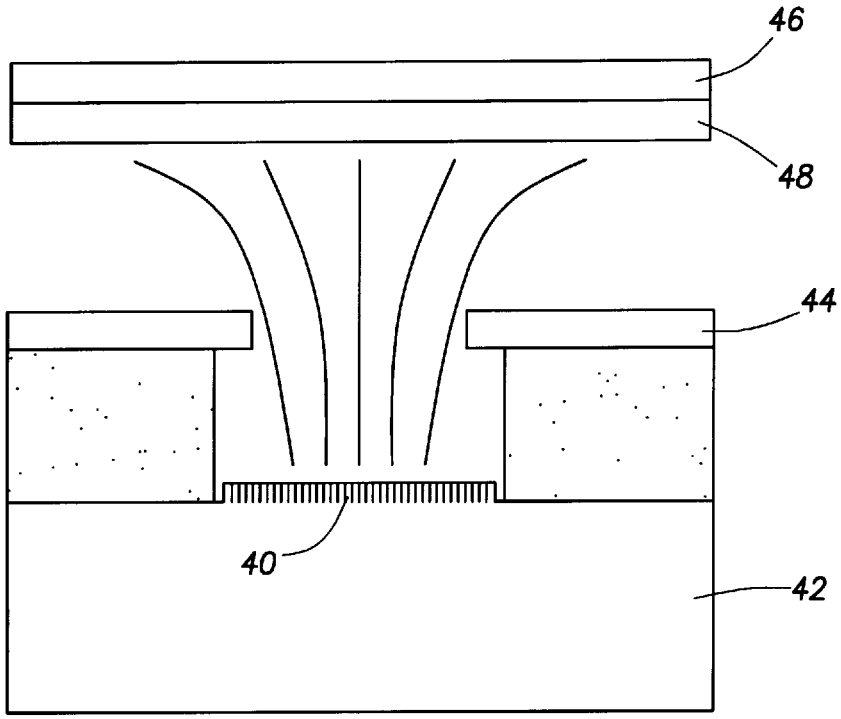
FIG.5

GROUP III NITRIDE FIELD EMITTERS

BACKGROUND OF THE INVENTION

1. Field of the Invention

This invention relates to field emission cathodes and method for making. More particularly, group III nitride thin films grown on silicon or other substrates to form a high density of field emission micro-tips and method for making are provided.

2. Description of Related Art

Field emission of electrons from solid surfaces can provide a cold cathode for use in displays and other devices of vacuum microelectronics. In field emission, flow of electrons from the surface of a solid material into a surrounding vacuum occurs under the influence of an applied electric field. In order to be emitted, an electron must propagate through a potential barrier between the surface and the vacuum. Quantum mechanical tunneling makes such propagation possible.

The potential barrier that the electron must overcome depends on the material's "electron affinity," which is a constant for each given surface and is different for different materials. Most materials have large positive electron affinity, but a few materials exhibit low or even negative electron affinity. These latter materials need a very low applied electric field for field emission to occur. Examples of materials with low or negative electron affinity are specific surfaces of diamond, gallium nitride, aluminum nitride, boron nitride and other group III nitrides. Alloys of Group III nitrides are also included among low or negative electron affinity materials—ternary alloys such as AlGaN, InGaN, InAlN and quaternary alloys such as AlGaInN. These materials have composition-dependent bandgap and, therefore, composition dependent electron affinity.

Prior art field emission devices rely on various phenomena for their properties. In one approach, the enhancement of field emission current and lowering of the threshold voltage is achieved by making an emitter in the shape of a sharp tip. Such a geometry concentrates the applied voltage to a very small area and creates strong electric fields. These microtip cathodes have been used for years in field emission displays. Such microtips are described, for example, in patents to Spindt, including U.S. Pat. No. 4,857,799. Experience reveals several limitations of the microtip cathodes. They are difficult to manufacture, variation of emission current can be significant over large areas such as those required for flat displays, the lifetime of the emission tip is low due to the large current flow through a very small area and the high vacuum required during operation can be expensive.

In another approach to develop field emitters, materials with reduced electron affinity are used to form a planar surface. An example of this approach is provided in U.S. Pat. No. 5,686,791, suggesting the use of amorphic diamond with imbedded micro-crystallites that presumably have low or negative electron affinity. Diamond surfaces are very sensitive to oxygen, however, and must be packaged under a vacuum, which increases fabrication cost. This limits the use of diamond for such applications as ion source cathodes or micro electromechanical systems (MEMS), for example, where oxygen is often a process environment. Also, integration with well-developed Si technology is very difficult in the case of diamond.

Nitrides have also been suggested as planar field emitters. For example, the paper by Sowers et al, ("Thin films of aluminum nitride and aluminum gallium nitride for cold cathode applications,." (App. Phys Lett. 71 (16), Oct. 20, 1997)) discusses nitride layers deposited on a silicon carbide substrate. Gallium nitride is a wide bandgap material with a low electron affinity (2.7 eV) that has recently attracted attention as a material for field emission (FE) devices—because of this low electron affinity and its high chemical and mechanical stability. Field emission cathodes fabricated from GaN should have longer lifetimes because of their high sputtering resistance and low sensitivity to residual gases, especially oxygen. Only a few reports have been published regarding the field emission properties of GaN. Recently, Underwood et al ("GaN field emitter array diode with integrated anode") and Kozawa et al ("Fabrication of GaN field emitter arrays by selective area growth technique") reported field emission from GaN micro-sized hexagonal pyramids grown by selective-area metal organic chemical vapor deposition on sapphire substrates, . In both studies the threshold electric field for emission was high: 195 V/$\mu$m and 100 V/$\mu$m, respectively, in comparison with the best results for diamond—about 0.5–2.0 V/$\mu$m. In addition, emission current densities were low. Most results to date are on insulating sapphire substrates, which require significant processing to achieve the sharp structures necessary to enhance surface electron emission. Silicon carbide is a less commonly used conductive substrate for GaN hetero growth. Both types of substrates are relatively expensive compared with silicon, and are not available in large sizes such as the 10-inch wafers of silicon. Size limitations can be a significant limitation in applications such as displays.

There have been several reports of cubic and hexagonal GaN deposition on Si wafers. (Yang et al, "High quality GaN-InGaN heterostructures grown on (111) silicon substrates") Although the GaN/Si materials exhibited good optical and electrical properties, field emission data from these films is unavailable.

What is needed is a stable field emission device that can reduce fabrication cost of field emitters, making them compatible with current Si growth technologies, and make, for the first time, monolithic integration of field emitters with Si-based driving circuitry possible. The field emitter should be chemically stable in oxygen so that cathodes can operate at much higher pressures and oxygen can be tolerated, and it should be long-lived even at high current levels.

Uniform emission current over large areas is also desired.

SUMMARY OF THE INVENTION

Low electron-affinity field emission device is provided based on a group III nitride thin film grown on a substrate under conditions of lattice mismatch to produce a columnar growth pattern which produces sharp crystalline tips at a surface density which may be more than about $10^9$ tips per $cm^2$. Self-aligned growth of nitride in a textured columnar structure occurs due to lattice mismatch between the group III nitride and a substrate such as (111) silicon. Suitable growth conditions use chemical vapor deposition in a reactor containing a plasma which may be produced by electron cyclotron resonance or other thin film growth processes. Silicon or other elements may be used as a dopant for the group III nitride. This columnar growth results in an array of small micro-tips each consisting of highly conductive single crystals.

Such an array of micro-tips results both in a significant reduction of the electric field necessary to turn on the emission current and in a lower total current per individual tip. Very high current densities and long operation life times e thus achieved.

BRIEF DESCRIPTION OF THE DRAWINGS

FIG. 1 is a sketch of apparatus suitable for use in the methods of this invention.

FIG. 2 is a drawing of the cross-sectional view of the columnar field emitter based on a transmission electron microscope image.

FIG. 4 is the Fowler-Nordheim plot of the data of FIG. 3.

FIG. 5 is a sketch of one embodiment of a field emission display using the columnar flat field emitter of this invention.

DESCRIPTION OF THE PREFERRED EMBODIMENTS

Figure 3:
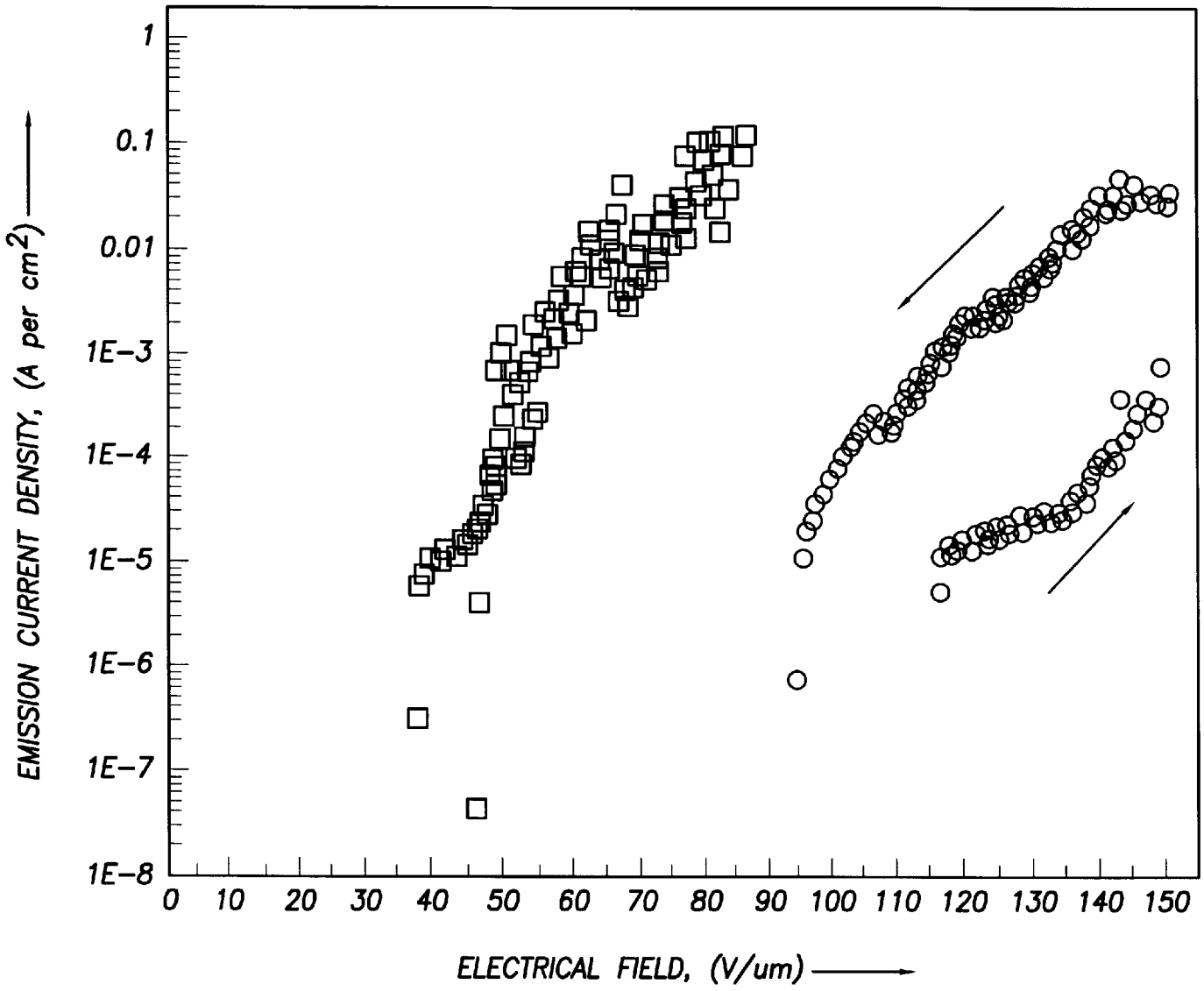
FIG. 3 is a graph of emission current density vs. applied electrical field for the columnar field emitter.

Referring to FIG. 1, growth apparatus 10 includes growth chamber 12 for the deposition of group III nitride materials in columnar form. Substrate 14 is mounted on heater 16 that can provide a temperature up to 1000° C. Gallium source 18 is an effusion cell that provides a flux of Ga molecules into the vacuum by evaporation. Any group III element can be substituted for gallium. Additional sources are added if a group III alloy is to be grown. Similarly, source 20 is used for Si or any other dopant material that is to be used. Both sources are heated to a temperature up to 1300° C. in order to provide sufficient molecular flux for the growth. Nitrogen source 22 is part of a commercial electron cyclotron resonance plasma source, such as supplied by Applied Science and Technology, Inc. of Woburn, Mass. This source is fed by ultra-high pure nitrogen from gas cylinder 24 through commercial mass-flow controller 26. During the growth of a film, process vacuum growth chamber 12 is pumped by any means so that the process pressure is below atmospheric. Preferably, pressure is pumped to a high-vacuum to ensure a clean growth environment. In order to improve the base vacuum, chamber 12 may be cooled during the growth using liquid nitrogen cryogenic panel 28.

A sketch of a columnar field emitter according to this invention is shown in FIG. 2. The sketch is based on Transmission Electron Microscope (TEM) images of films grown according to the method of this invention. The TEMs were made at a magnification of $5\times10^6$. Columns could be observed throughout the film and the microtips could be seen, although the pattern was random and not always as ordered as this sketch indicates. Referring to the sketch, conductive or insulating substrate 30 is covered with buffer layer 32 and then columnar film 34 which forms microtips 36. It was found that the key to growth of the columnar structure was that the lattice structure of substrate 30 was different from the lattice structure of the film 34. In the case of GaN on silicon, there is a different structure in that the structure of silicon is cubic and GaN is hexagonal. The columnar films were clearly observed to have a hexagonal structure, even when grown on silicon. The columnar growth may also be attained by utilizing the difference in lattice constants for the substrate and emission layer in case they have similar structure. Other substrates may be used having different lattice constants from the group III nitride, but silicon has a significant cost advantage under current industry conditions, and wafers are available in large (10 inch) sizes.

Buffer layer 32 may be used for creation of a template for the growth of a final nitride layer 34. A buffer layer may not be necessary for silicon and other substrates. Some substrates, such as GaAs or InP, will decompose at the high temperature of GaN deposition, and a low temperature buffer layer can be used to prevent the decomposition. A low-temperature GaN buffer layer on silicon can be used to avoid rapid formation of an insulating $Si_3N_4$ layer at high temperature. The thickness of the buffer layer can vary from zero to a few hundred angstroms.

The columnar growth of the group III nitride film occurs in certain growth conditions when accumulated microscopic strain, caused by a large lattice mismatch between the substrate and the film, causes cracks in the growing film. These cracks are parallel to the growth direction plane. The result is that the growth of the film continues on each individual template or domain thus the microscopic columns form. From the image of the TEM, it can be seen that a columnar structure with an average column diameter of about 100 nm and a surface tip sharpness less than 100 nm is formed under growth conditions described below. The surface density of the tips of the columns in this case is about $5\times10^9$ tips/cm$^2$. This density is at least 4–5 orders of magnitude higher than the density of tips in prior art field emission devices.

Substrate 30 is preferably a commercial Si wafer, but other substrates may be used which have a lattice constant in the exposed surface different from the nitride lattice constant. Buffer layer 32 is preferably a 300 Å-thick GaN or other group III nitride film grown at a temperature of about 500° C.–600° C. or lower. Emitting layer 34 is preferably about a 1 $\mu$m-thick GaN or other group III nitride film doped by Si or another element from group II, group IV or group VI of the periodic table. Thickness of the emitting layer may vary from about 0.5 micrometer to a few microns, but a thickness of about 1 micron is sufficient and is less expensive than thicker layers.

The nitride emitters can be grown on inexpensive substrates such as silicon. Similar results are expected on even less expensive materials, such as glass. The important criterion is the lattice structure of the substrate material as compared with the lattice structure of the nitride film. Since the deposition process is simple and non-destructive, this will allow for the growth of emitter structures on previously processed integrated circuits.

Doping seems to play an important role in the field emission properties of the nitride films. While for this work we used Si with a doping level of about $5\times10^{19}$ cm$^{-3}$, other elements from group II, group IV or VI of the periodic table of elements may be used to dope the field emission layer. The most practical candidates are Mg, O, C, Be, Zn, Sn, Te, As and P. The doping levels can be from about $1\times10^{16}$ to about $1\times10^{21}$ cm$^{-3}$.

EXAMPLE a. Substrate Preparation

Commercial 500 $\mu$m thick, n-type low-resistivity Si wafers with a (111) surface orientation were etched first in HF (10% water solution) for 1 minute. The etching process was terminated by washing the wafer in methanol without contact with air. In addition, the wafer was cleaned in an ultrasound bath with methanol twice for 10 minutes each. Care was taken to avoid contact of the substrate with air. The wafer was transferred to the loading area immersed in methanol. Just before loading, the wafer was dried by nitrogen flow. The wafer was then loaded immediately.

b. Loading of the Substrate Into the Growth Chamber and Annealing

Immediately after the Si wafer was dried by nitrogen, it was transferred to the loading chamber and on to a molybdenum sample carrier and placed on the transfer rod. (It is preferable to carry out all procedures in a nitrogen ambient in order to avoid any contact between the etched Si wafer and air.) The loading chamber was pumped down by an oil-free pump to a pressure below $10^{-7}$ torr. Next, the sample was transferred to the growth chamber by the transfer rod and was mounted on the sample heater. The main chamber was pumped by an oil-free pump until background pressure was below $1\times10^{-7}$ torr. One hour before growth, liquid nitrogen was introduced into the cryo-panel and a continuous flow was established throughout the growth process. The flow rate should be high enough to provide liquid nitrogen up to the exit of the cryo-panel. When the pressure in the main chamber is $1\times10^{-8}$ torr, the sample is ready for out gassing. The temperature must be increased slowly (about 10°/min) in order to avoid thermal cracking of the wafer. Maximum temperature of out gassing was 800° C. Chamber pressure during the out gassing process is preferably below about $5\times10^{-7}$ torr. The wafer is to be kept at this high temperature for 30 minutes. During this time, the main shutter between the sample and growth sources was closed as well as the Ga and Si shutters and the Ga and Si cells were heated to 1050° C. and 1300° C., respectively. The heating rate should be calculated so that all cells can be at these high temperature for the last 10 minutes before the next step begins. Following this step, the sample temperature is reduced to 500° C., the Ga cell temperature was reduced to 960° C., and the Si cell temperature was reduced to 1250° C. The temperature of the cells and sample must be preliminarily calibrated.

c. Buffer Layer Growth.

When the sample and cell temperatures are stable (no more than 0.1° C./min variation), the Ga, Si, and main shutters were opened simultaneously. The deposition had commenced. After 10–15 sec, nitrogen was introduced into the growth chamber at a flow rate of 2 sccm. The resulting chamber pressure was in the low $10^{-4}$ torr range. The ECR magnet current was increased to 17.5 A, and the microwave power of the ECR source was set to 250 watts. The plasma is at this point ignited. The nitrogen source does not have a shutter and was thus always open. The distance between the substrate and the sources was about 6 inches.

After 2 minutes of deposition, all shutters were closed. The Ga cell temperature was increased to 1045° C. The Si cell temperature did not change and the sample temperature was increased to 800° C.

d. Final Layer Growth.

When the temperature was stable, the main, Ga cell, and Si cell shutters were opened. Growth of the final layer was carried out for 2 hours. The substrate should be rotated continuously during growth, preferably at a speed of about 10–20 rpm. After the growth, all shutters were closed, nitrogen flow was set to 0, and both ECR power and magnet current were slowly decreased to zero. Gallium and Si cell temperatures were set to 600° C. and 700° C., respectively. Sample temperature was reduced to 350° C. As soon as the temperature was stable, the sample was transferred into the loading chamber. After 1 hr, when the sample temperature was close to room temperature, it is taken out. This finished the growth process of the columnar GaN field emitter layer.

FIG. 3 presents the measured dependence of emission current as a function of applied electrical field for a emitter made according to the procedure described above. The field emission characteristics were characterized in an oil-free high-vacuum chamber with a base pressure below $10^{-8}$ torr. Four tungsten tips, with a 20 micrometer curvature radius, were placed at a distance between 10 and 100 micrometers from the sample surface. A high DC voltage up to 8 kV was applied between the sample and each probe separately to induce the field emission current. The measurement procedure included the recording of the emission current during the automated increase and decrease of the electrical field. Multiple cycles were acquired to analyze the current-voltage characteristics as a function of the cycle number and evaluate the stability of the material under test. It is seen that the threshold electric field is in the range of 30–40 V/$\mu$m and current density is as high as 100 mA/cm$^2$. FIG. 4 shows the Fowler-Nordheim (FN) plot for the data of FIG. 3. This plot is linear over 6 decades, which confirms the field emission origin of the measured current. Although the emitter has high current density, the high surface density of micro-tips allow for reduction of the total current from each individual tip, which will increase the lifetime of the emitter. In addition, fabrication of tips from nitride materials will allow for operation in low-vacuum, corrosive environments and in oxygen- contaminated atmospheres.

FIG. 5 illustrates the application of the emitter of this invention in an emission display. Nitride columnar field emitter 40 is shown on substrate 42. An electron extracting voltage is applied between substrate 42 with emitter 40 and metal grid 44. Extracted electrons are further accelerated by an electrical potential between conductive screen 46 having luminescent phosphor 48 on its surface. Columnar emitter 40 allows electron emission over a planar area much greater than that of a point emitter. Assuming the increase in lifetime for the invented emitter can be estimated as a ratio of the number of tips for different emitters, and the size of a typical emitting area for a single tip to be 100×100 $\mu$m, the lifetime of the emitter of this invention will be about $5\times10^6$ greater than the lifetime of a single tip.

It should be understood that various modifications of the techniques, procedures, methods, materials, and equipment will be apparent to those of ordinary skill in the art. It is intended that all such variations within the scope and spirit of the appended claims be embraced thereby.

What we claim is:

1. A field emitter, comprising:

a substrate having a lattice structure;

a film comprising a nitride compound of a Group III element or elements, the compound having a lattice structure different from the lattice structure of the substrate and a dopant, the dopant selected from among the group of elements consisting of Group II, Group IV and Group VI of the periodic table of elements, the film forming a field emitter.

2. The emitter of claim 1 wherein the substrate is silicon, the silicon having a crystalline face.

3. The substrate of claim 2 wherein the crystalline face of silicon is the (111) face.

4. The emitter of claim 1 further comprising a buffer layer.

5. The emitter of claim 1 wherein the group III element is gallium.

6. The emitter of claim 1 wherein the nitride compound is an alloy of group III elements.

7. The emitter of claim 1 wherein the dopant is silicon.

8. The emitter of claim 1 wherein the concentration of dopant is from about $1\times10^{16}$ to about $1\times10^{21}$ per cm$^{-3}$.

9. The emitter of claim 1 where the dopant is selected from among the group of elements consisting of Mg, O, C, Be, Zn, Sn, Te, As and P.

10. A field emission display device, comprising:

a field emitter, the field emitter comprising a substrate having a lattice structure, a film on the substrate, the film comprising a nitride compound of a Group III element or elements, the compound having a lattice structure different from the lattice structure of the substrate and a dopant, the dopant selected from among the group of elements consisting of Group II, Group IV and Group VI of the periodic table of elements, the film forming a field emitter; and an anode screen having a phosphor thereon.

11. The display device of claim 10 further comprising a grid between the field emitter and anode.

* * * * *